US007196974B2

(12) United States Patent
Yang et al.

(10) Patent No.: US 7,196,974 B2
(45) Date of Patent: Mar. 27, 2007

(54) CLOCK WITH MOVABLE NUMBERS HAVING HANGERS FOR DOLL CLOTHES

(75) Inventors: Tina Y Yang, Anaheim, CA (US); James Holmes, Los Angeles, CA (US); Jean M Kuerten, Redondo Beach, CA (US); Mark S Wittenberg, Rossmoor, CA (US)

(73) Assignee: Mattel, Inc. DE (US)

( * ) Notice: Subject to any disclaimer, the term of this patent is extended or adjusted under 35 U.S.C. 154(b) by 90 days.

(21) Appl. No.: 11/180,077

(22) Filed: Jul. 12, 2005

(65) Prior Publication Data

US 2007/0014194 A1 Jan. 18, 2007

(51) Int. Cl.
*G04B 19/04* (2006.01)
*G04B 19/20* (2006.01)

(52) U.S. Cl. ..... 368/228; 368/223

(58) Field of Classification Search ..... 368/10, 368/223, 228, 232; D10/1
See application file for complete search history.

(56) References Cited

U.S. PATENT DOCUMENTS

| | | | |
|---|---|---|---|
| 1,887,303 | A | 11/1932 | Grossman |
| 2,718,113 | A | 9/1955 | Bramwell |
| 2,801,145 | A | 7/1957 | Jones |
| 4,208,870 | A | 6/1980 | Cullom |
| 5,167,564 | A | 12/1992 | Lord |
| D338,931 | S | 8/1993 | Glonek et al. |
| 5,787,055 | A | 7/1998 | Alpert |
| D416,492 | S | 11/1999 | Peters |
| 6,089,424 | A | 7/2000 | Colquhoun |
| 6,278,664 | B1 | 8/2001 | Huffman |
| 6,416,216 | B1 | 7/2002 | Haughey |
| 6,421,302 | B1 | 7/2002 | Wimberely |
| D466,820 | S | 12/2002 | Chan |
| 6,807,129 | B1 | 10/2004 | Chan |
| 6,836,450 | B2 | 12/2004 | Gilbert |
| 2003/0235118 | A1 | 12/2003 | Lai |

FOREIGN PATENT DOCUMENTS

| | | |
|---|---|---|
| JP | 06043263 | 2/1994 |

*Primary Examiner*—Vit Miska
*Assistant Examiner*—Jeanne-Marguarite Goodwin
(74) *Attorney, Agent, or Firm*—Klein, O'Neill & Singh, LLP; James G. O'Neill

(57) ABSTRACT

A clock assembly (10) having a removable central clock mechanism (12) with time indicating hands (18, 20, 21) is adapted to be mounted on a flat vertical surface (26) with and separate removable hour disks (14) having numerals (34) connected to hanger elements (36) adapted to be mounted on the vertical surface around the central clock mechanism in correct positions to tell time. Doll clothes (40) are selectively hung on or removed from the hanger elements behind the numerals.

14 Claims, 3 Drawing Sheets

CLOCK WITH MOVABLE NUMBERS HAVING HANGERS FOR DOLL CLOTHES

BACKGROUND OF THE INVENTION

1. Field of the Invention

This invention generally relates to clocks, and more particularly, to a clock having a movable central clock mechanism and movable numbered disks with hangers for removably holding doll fashions, to provide enjoyment to a child in indicating time and selecting various ensembles to dress a doll.

2. Description of the Prior Art

The clock art is old and crowded and includes many types of timepieces or clocks, including some that are hung on a wall and have fixed time indicators that can have a movable reminder selectively secured in indexing means on the clock face to provide a visual reminder that some action, such as take medication, is required. For example, see U.S. Pat. No. 4,208,870. However, the clock disclosed in this patent includes a standard face secured to an operating mechanism. The face has hour numerals painted or secured on it surface and a number of indicator holes are formed at the perimeter of the face, inwardly from the hour numerals, for hanging articles such as a pill bucket, medication spoon, or the like on the clock face. The clock of this patent has no play value and does not include a separately movable clock mechanism and removable number indicators. Nor does this clock include hanger elements associated with separate hour numerals for hanging doll clothes thereon.

Therefore, there exists a need in the art for a clock assembly having a central clock mechanism and separately movable numbered disks with hanger elements for removably holding doll fashions. There also exists a need for a method of mounting the separate elements of such a clock on a wall or other flat surface and using the mounted clock to tell time and to add on and remove doll clothing from the various hour numerals.

SUMMARY OF THE INVENTION

Accordingly, it is a general object of the present invention to provide an improved clock. It is a particular object of the present invention to provide an improved clock assembly on which doll clothes may be selectively hung. It is a further particular object of the present invention to provide an improved clock assembly having a central clock mechanism having at least hour and minute hands as well as removable hour numerals having hangers associated therewith. It is yet a further particular object of the present invention to provide an improved clock assembly having a removable central clock mechanism with time indicating hands and separate removable hour disks having numerals with hanger elements associated therewith for selectively adding and removing doll clothes. And, it is a still further particular object of the present invention to provide an improved method of providing a clock assembly by removably mounting a central clock mechanism having time indicating hands on a flat vertical surface, removably mounting separate hour disks with numerals having hangers in positions on the vertical surface around the central clock mechanism so that the time indicating hands indicate the correct time and selectively adding and removing doll clothes from the hangers on the numerals.

These and other objects of the present invention are achieved by providing a clock having a removable central clock mechanism with time indicating hands adapted to be mounted on a flat vertical surface and separate removable hour disks having numerals with hanger elements thereon adapted to be mounted on the vertical surface around the central clock mechanism. The central clock mechanism is removably mounted on a flat vertical surface; the hour disks with numerals having hangers are removably mounted in positions on the vertical surface around the central clock mechanism so that the time indicating hands indicate the correct time; and doll clothes are selectively hung on or removed from the hangers on the numerals.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1:
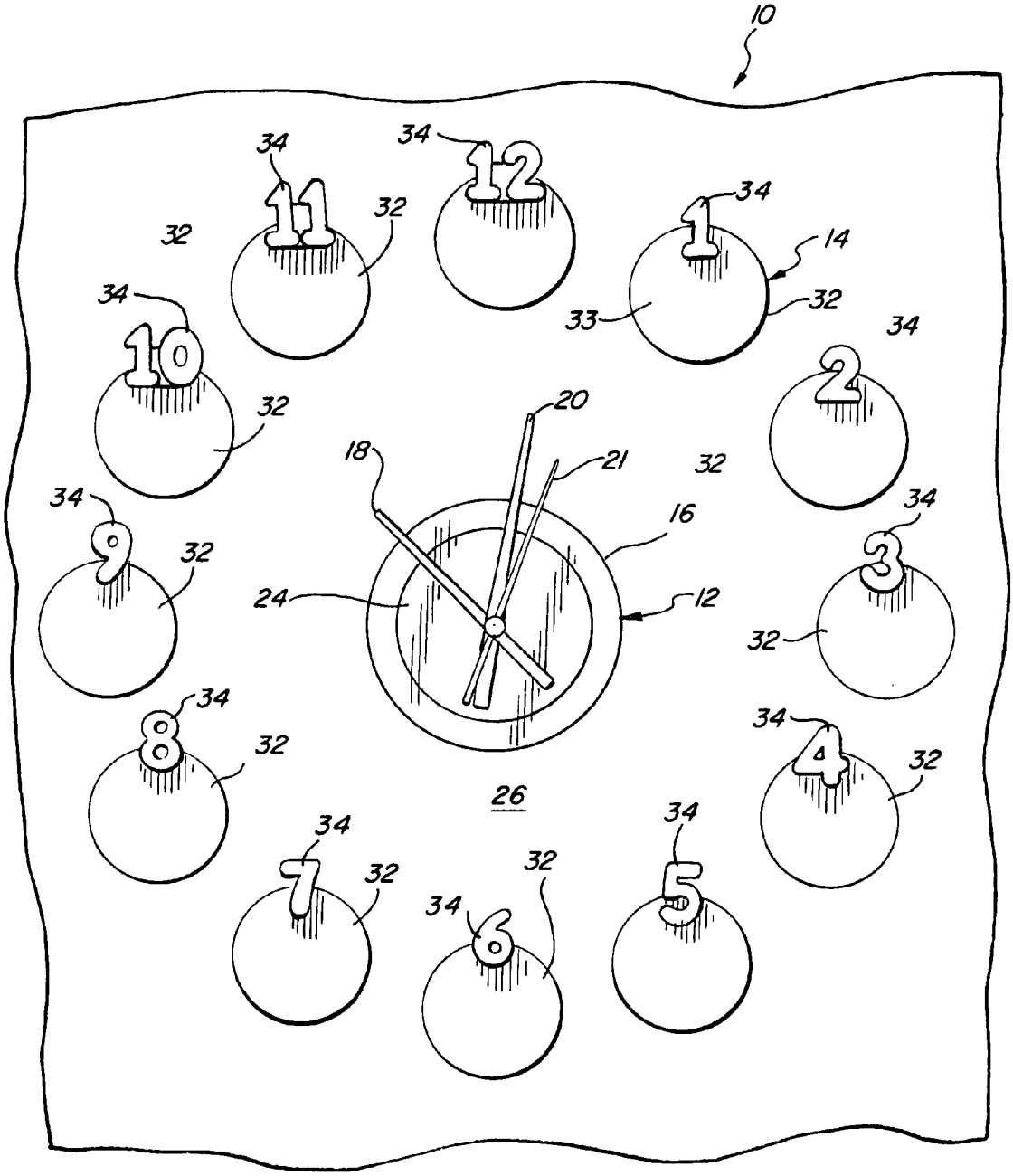
FIG. 1 is a front elevational view of the clock assembly of the present invention showing a separate clock mechanism and separate hour numeral disks removably mounted on a vertical surface, such as a wall.

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for an improved clock assembly having a central clock mechanism with time indicating hands and separate hour numeral disks with doll clothes hangers, generally indicated at 10.

A currently preferred embodiment of the clock assembly 10 has a separate central clock mechanism 12 and a plurality of removable hour numeral assemblies or disks 14. The central clock mechanism 12 is comprised of an internal operating mechanism of any known type, either electrical or mechanical in a housing 16, to operate or rotate hands 18, 20, 21 such as hour, minute and second hands. The second hand 21 could, of course be eliminated, if desired. The central clock mechanism 12 may include a design or printing 22, such as a name, decoration or the like on a front face 24.

Figure 5:
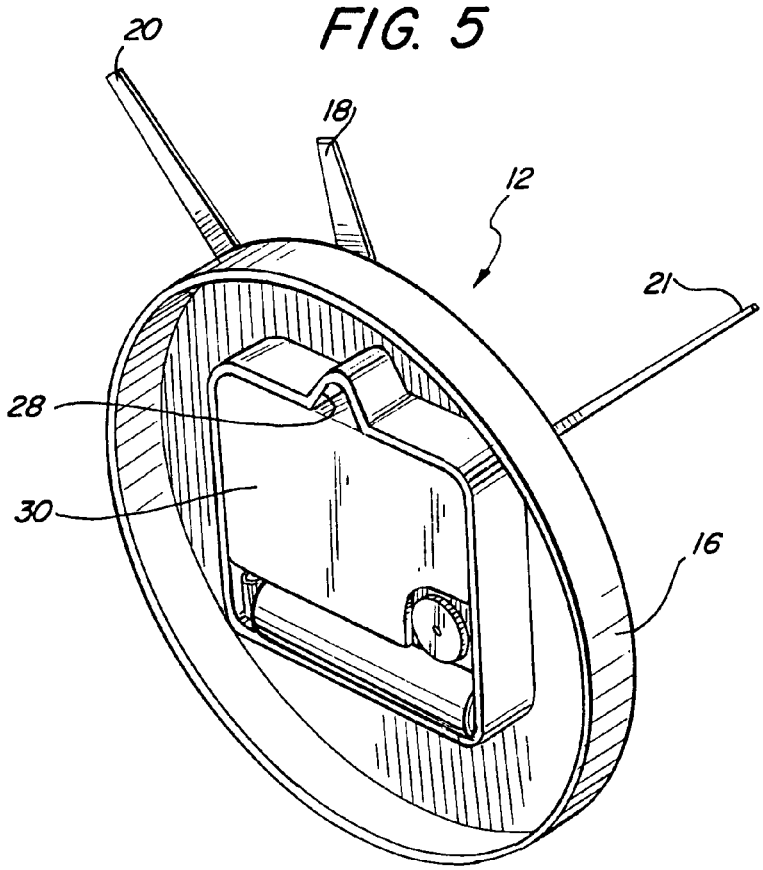
FIG. 5 is a rear perspective view of the central clock mechanism and time indicating hands of the clock assembly of the present invention.

The central clock mechanism 12 is removably held on or secured to a vertical surface 26, such as a bulletin board, room divider or wall, by any desired means. In a preferred embodiment, the central clock mechanism 12 has at least one hanger portion or opening 28 made part of or secured on an operating mechanism 30 that may be battery operated and which may be hung or supported on one or more brads, nails or the like, driven into the vertical surface 26 and held in the opening in a known manner, to support the central clock mechanism (see FIG. 5).

Figure 2:
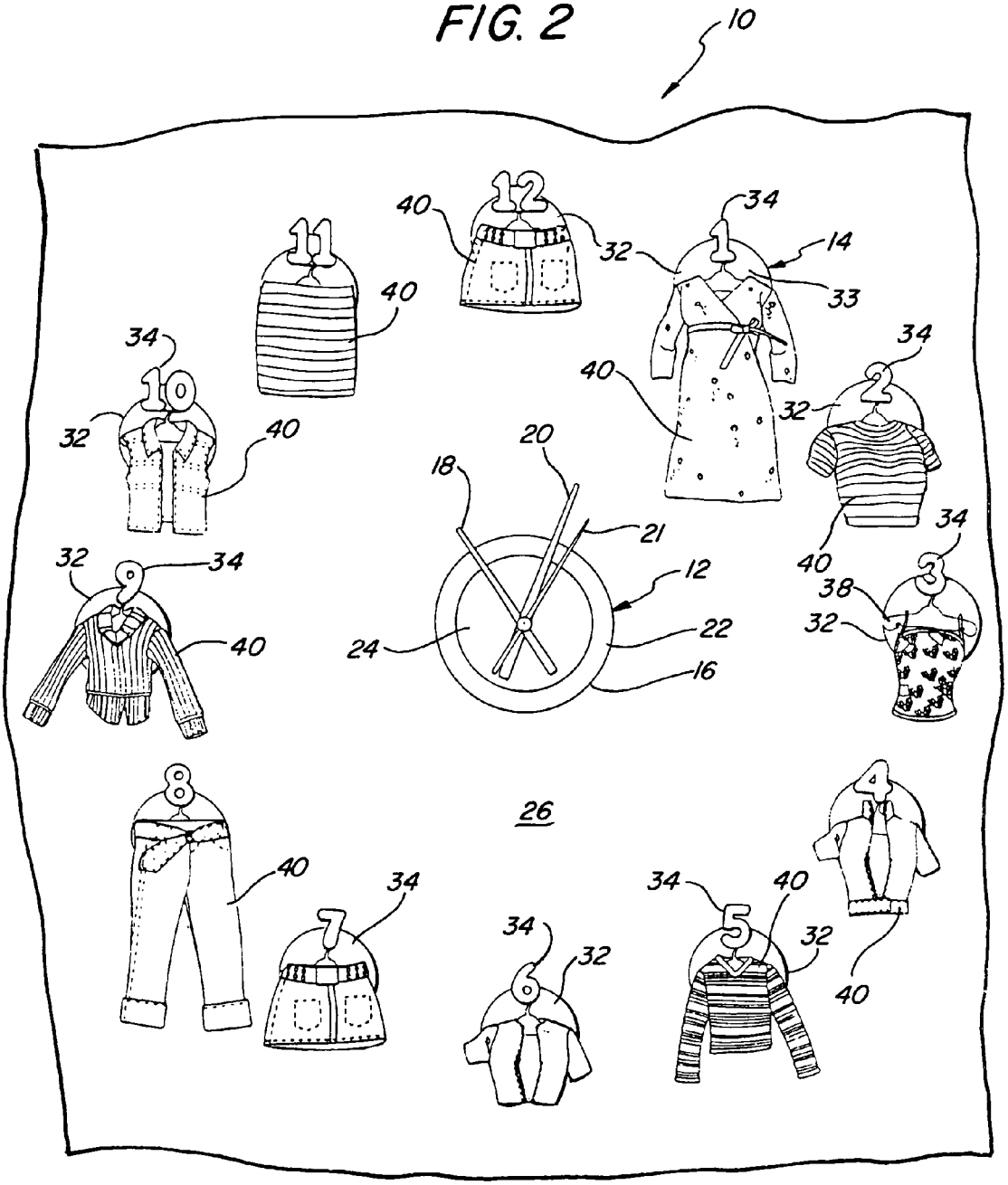
FIG. 2 is a further front elevational view of the clock assembly of FIG. 1 having doll clothes held on hangers and removably hung on separate hanger elements on the separate hour numeral disks.
Figure 3:
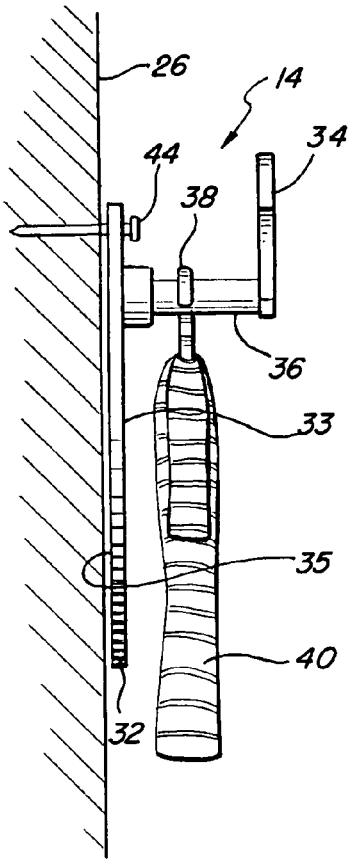
FIG. 3 is a side elevational view of one of the hour numeral disks removably secured to a vertical surface with a doll outfit hung on a hanger removably hung on a hanger element.
Figure 4:
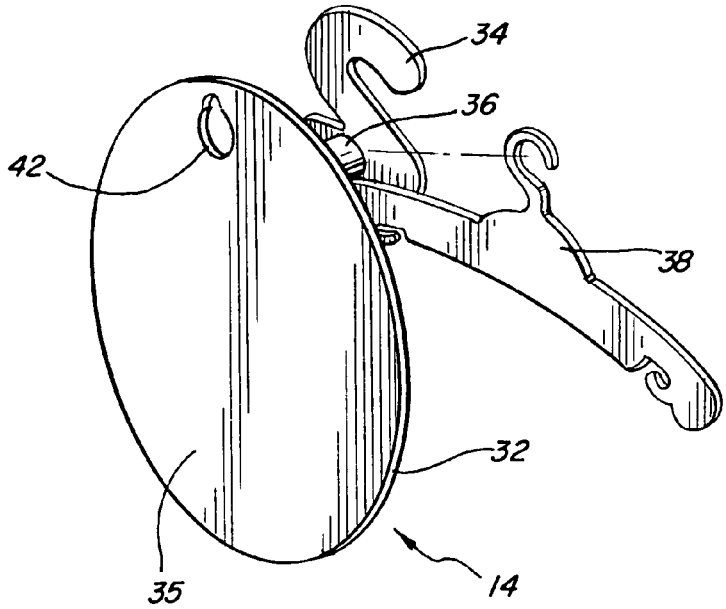
FIG. 4 is a rear perspective view of one of the hour numeral disks of the clock assembly of the present invention showing a hanger for a doll outfit that may be selectively hung on the hanger element.

The separate hour numeral assemblies 14 may take any desired form or shape and are removably secured to the vertical surface 26 in any desired or known manner. In a preferred embodiment, the separate hour numeral assemblies 14 have substantially circular bodies 32 with front surfaces 33 and rear surfaces 35. Numerals 34 are secured to, but spaced from the front surfaces 33 of the bodies 32 by means of arms 36. The numerals 34 may take any desired shape and are numbered from 1–12 to indicate or show the correct time when correctly mounted and pointed to by the hands 18, 20, 21. The arms 36 serve to space the numerals 34, a selected distance from the front surfaces 33 of the bodies 32, and further act as hanger elements or portions to enable hangers 38, having individual doll outfits 40 thereon to be selectively hung on each hour numeral assembly 14 (see FIGS. 2–4). Each of the separate hour numeral assemblies 14 includes an aperture or opening 42 in its body 32, which aperture may have a keyhole shape (see FIG. 4), to enable each hour numeral assembly to be selectively hung or supported on a brad, nail or the like 44 driven into the vertical surface 26 in the desired positions shown with its rear surface 35 against the vertical surface. That is, the hour numeral disks 14 are mounted on the vertical surface 26, spaced around the central clock mechanism 12, so that the time indicating hands 18, 20, 21 point to and indicate the correct time, as well as separate doll outfits 40 selectively hung on the arms 36 of the hour numeral disks.

The separate elements of the clock assembly 10 may be made in any desired manner in any desired size, from any desired material having any desired color or finish. The separate elements are preferably made from plastic so as to be easily handled by a child when hanging the central clock mechanism 12 and the plurality of removable hour numeral assemblies or disks 14 on the vertical surface 26 and during play, when hanging on or removing doll clothes 40 from each numeral disk for use when dressing or undressing a fashion or other doll.

There has thus been described a novel and unique clock assembly which has separate central clock mechanism and separate hour numeral disks that are easily and simply mounted on a vertical surface to show the correct time. Separate doll outfits may be selectively hung on hangers and hung on or removed from hanging portions on the separate hour numeral disks placed around the central clock mechanism.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than as specifically described herein.

What is claimed is:

1. A clock assembly, comprising:

a central clock mechanism having time indicating hands mounted on a housing having an operating mechanism and at least one opening adapted to selectively and removably hang the housing on a vertical surface; and a plurality of separate hour number disks having bodies with hour numbers and hanger portions secured thereto, adapted to be positioned on a vertical surface around the central clock mechanism and have doll outfits hung on or removed from the hanger portions.

2. The clock assembly of claim 1 wherein the central clock mechanism has a front face with a design element thereon.

3. The clock assembly of claim 2 wherein the plurality of separate hour number disks include substantially round bodies with numbers secured to arms extending from a first surface of the bodies, which arms serve as hanging portions for doll clothes.

4. The clock assembly of claim 3 wherein the substantially round bodies have apertures formed therein to enable the separate hour number disks to be removably mounted on a vertical surface.

5. The clock assembly of claim 3 wherein the substantially round bodies have apertures formed therein to enable the separate hour number disks to be removably mounted on a vertical surface.

6. The clock assembly of claim 5 wherein the central clock mechanism has a front face with a design element thereon.

7. The clock assembly of claim 1 wherein the plurality of separate hour number disks include substantially round bodies with numbers secured to arms extending from a first surface of the bodies, which arms serve as hanging portions for doll clothes.

8. A clock assembly, comprising:

a central clock mechanism having time indicating hands mounted on a housing with a front face and containing an operating mechanism;

at least one opening formed in the operating mechanism adapted to selectively and removably hang the central clock mechanism on a vertical surface; and a plurality of separate hour number disks having bodies with spaced hour numbers secured to doll clothing hanger portions secured thereto, adapted to be positioned on a vertical surface around the central clock mechanism and have doll outfits hung on or removed from the doll clothing hanger portions.

9. The clock assembly of claim 8 wherein the plurality of separate hour number disks include substantially round bodies with the spaced hour numbers secured to arms extending from a first surface of the bodies, which arms serve as the doll clothing hanger portions.

10. The clock assembly of claim 9 wherein the front face has a design element . . . thereon formed around its periphery.

11. The clock assembly of claim 10 wherein the time indicating hands on the central clock has minute, hour and second hands rotatably mounted on the front face.

12. A clock assembly, comprising:

a central clock mechanism having time indicating hands mounted on a housing with a front face and containing an operating mechanism;

at least one opening formed in the operating mechanism for removably mounting the central clock mechanism on a vertical surface; and a plurality of separate hour number disks having bodies with spaced hour numbers secured to doll clothing hanger portions secured to the bodies;

the plurality of separate hour number disks removably secured to the vertical surface in positions around the central clock mechanism whereby they indicate the correct time; and a plurality of doll outfits selectively hung on hangers and selectively hung on or removed from the doll clothing hanger portions of the plurality of separate hour number disks.

13. The clock assembly of claim 12 wherein the plurality of separate hour number disks include substantially round bodies having apertures therein and wherein the spaced hour numbers are secured to arms extending from a first surface of the bodies, which arms serve as the doll clothing hanger portions.

14. The clock assembly of claim 12 wherein the front face has a design element thereon formed around its periphery.

* * * * *